US012137783B2

(12) United States Patent
Aquino et al.

(10) Patent No.: US 12,137,783 B2
(45) Date of Patent: Nov. 12, 2024

(54) REPOSITIONABLE BOTTLE HOLDER

(71) Applicant: TUMI, INC., Edison, NJ (US)

(72) Inventors: Cristian G. Aquino, Holmdel, NJ (US); Elisa Cohen, New York, NY (US)

(73) Assignee: TUMI, INC., Edison, NJ (US)

( * ) Notice: Subject to any disclaimer, the term of this patent is extended or adjusted under 35 U.S.C. 154(b) by 213 days.

(21) Appl. No.: 17/620,449

(22) PCT Filed: Jun. 18, 2019

(86) PCT No.: PCT/US2019/037752
§ 371 (c)(1),
(2) Date: Dec. 17, 2021

(87) PCT Pub. No.: WO2020/256708
PCT Pub. Date: Dec. 24, 2020

(65) Prior Publication Data

US 2022/0322797 A1 Oct. 13, 2022

(51) Int. Cl.
*A45C 5/06* (2006.01)
*A45F 3/00* (2006.01)
*A45F 3/04* (2006.01)

(52) U.S. Cl.
CPC ..... *A45C 5/06* (2013.01); *A45F 3/04* (2013.01); *A45C 2200/20* (2013.01); *A45F 2003/001* (2013.01); *A45F 2200/0583* (2013.01)

(58) Field of Classification Search
CPC ..... A45C 5/06; A45C 2200/20; A45C 13/02; A45F 3/04; A45F 2003/001; A45F 2200/0583
(Continued)

(56) References Cited

U.S. PATENT DOCUMENTS 2,533,850 A * 12/1950 Syracuse ..... A45C 3/00 150/112
3,696,850 A 10/1972 Rosenblum
(Continued)

FOREIGN PATENT DOCUMENTS

CN 202085876 U 12/2011
CN 202354625 U 8/2012
(Continued)

OTHER PUBLICATIONS

International Search Report and Written Opinion of International Application No. PCT/US2019/037752 dated Feb. 12, 2020.
(Continued)

*Primary Examiner* — Don M Anderson
*Assistant Examiner* — Justin Caudill
(74) *Attorney, Agent, or Firm* — Lando & Anastasi, LLP

(57) ABSTRACT

A holder (32) that is configured to hold a container (34). The holder is secured to a carrying article, such as a backpack (10). In some embodiments, a backpack includes a main compartment (28) including a side wall (26) and a first zippered opening (26) in the side wall. The holder is attached to the side wall, and the holder is movable between a first position and a second position. In the first position the holder is within the main compartment, and in the second position the holder extends through the first zippered opening (84) and is accessible outside of the main compartment.

27 Claims, 9 Drawing Sheets

(58) Field of Classification Search
USPC ..... 190/111; 224/581
See application file for complete search history.

(56) References Cited

U.S. PATENT DOCUMENTS

| | | | | |
|---|---|---|---|---|
| 4,236,615 | A | 12/1980 | Ginat | |
| 5,158,220 | A * | 10/1992 | Glass | A45C 3/12 224/656 |
| 5,890,809 | A * | 4/1999 | Nelson | A45F 3/00 224/664 |
| 5,934,533 | A | 8/1999 | Callanan | |
| 6,367,674 | B1 * | 4/2002 | Tabor | A45F 3/04 224/653 |
| 6,581,736 | B1 | 6/2003 | Scicluna | |
| 6,619,447 | B1 | 9/2003 | Garcia, III et al. | |
| 7,600,620 | B2 | 10/2009 | Hammond | |
| 7,971,764 | B2 | 7/2011 | Sabbah | |
| 9,119,448 | B1 | 9/2015 | Hirshberg | |
| 10,307,006 | B2 * | 6/2019 | Knoll | B67B 7/16 |
| 10,575,611 | B2 | 3/2020 | Dingler et al. | |
| 10,667,600 | B2 | 6/2020 | Ji et al. | |
| 11,782,480 | B1 | 10/2023 | Hatfield et al. | |
| 2001/0042665 | A1 * | 11/2001 | Siwak | A45C 5/06 190/111 |
| 2002/0067610 | A1 * | 6/2002 | Marshall | A45C 15/06 362/156 |
| 2002/0104768 | A1 * | 8/2002 | Nevarez | A45C 3/00 206/315.11 |
| 2002/0113102 | A1 * | 8/2002 | Klamm | A45C 7/0077 383/4 |
| 2002/0195304 | A1 * | 12/2002 | Godshaw | A45C 5/06 190/111 |
| 2004/0195286 | A1 | 10/2004 | Greenhalgh et al. | |
| 2006/0102673 | A1 | 5/2006 | Collier | |
| 2011/0174584 | A1 | 7/2011 | Bedard | |
| 2012/0121210 | A1 | 5/2012 | Meyer et al. | |
| 2012/0223088 | A1 | 9/2012 | Bedard | |
| 2013/0126286 | A1 * | 5/2013 | Chehebar | A45C 13/02 190/108 |

FOREIGN PATENT DOCUMENTS

| | | | |
|---|---|---|---|
| CN | 205285452 | U | 6/2016 |
| CN | 206150760 | U | 5/2017 |
| FR | 2669518 | A1 | 5/1992 |
| JP | S588335 | U | 1/1983 |
| JP | 3126226 | U | 10/2006 |
| WO | 2020256708 | A1 | 12/2020 |

OTHER PUBLICATIONS

International Search Report and Written Opinion in International Patent Application No. PCT/US2020/062405 dated Mar. 1, 2021.

* cited by examiner

REPOSITIONABLE BOTTLE HOLDER

CROSS-REFERENCE TO RELATED APPLICATIONS

This application is a U.S. National Phase application, and claims the benefit of priority under 35 U.S.C. § 371, of International (PCT) Patent Application Serial No. PCT/US2019/037752, filed on Jun. 18, 2019, titled, "REPOSITIONABLE BOTTLE HOLDER," which is hereby incorporated by reference herein in its entirety for all purposes.

FIELD OF THE INVENTION

The present disclosure is related to carrying articles, such as articles of luggage and other articles, having a multi-positionable holder for carrying containers, such as water bottles.

BACKGROUND

Backpacks and other carrying articles often include external water bottle support structures. However, these water bottle support structures can create an undesirable aesthetic appearance and/or an unneeded structure when not in use. In addition, these structures can only be used externally to hold a water bottle or other container.

Documents that may be related to the present disclosure include:

U.S. Pat. No. 5,890,809 discloses a carrying bag with a deployable bottle pouch. The bag includes a pocket that contains a pull-out bottle pouch that is movable between a stored position concealed within the pocket and a deployed position for supporting and carrying a conventional sports water bottle or the like. In the stored position, the pouch is collapsed to fit into the pocket.

SUMMARY OF THE INVENTION

It is desirable to provide an improved carrying article, such as a backpack, having a holder for a container that can be positioned and used both outside a main compartment of the article and within the main compartment of the article. The article can include for example, backpacks, briefcases, tote bags, pocketbooks, purses, messenger bags, duffel bags, sports equipment bags, suitcases including soft-shell luggage and hard-shell luggage, and other bags.

According to an aspect of the present disclosure, there is provided an improved carrying article as described in the accompanying claims. According to another aspect of the present disclosure, a carrying article is provided, and the carrying article comprises a main compartment including a wall; a first opening in the wall; and a holder configured to hold a container, the holder being attached to the wall of the carrying article, the first opening and the holder being configured so that the holder is movable between a first position in which the holder is within the main compartment and can hold the container and a second position in which the holder extends through the first opening and is accessible outside of the main compartment and can hold the container outside of the main compartment.

In some embodiments, the holder includes a holder side wall, a holder bottom wall and a holder top opening, and wherein in the second position at least a portion of the holder side wall, the holder bottom wall and the holder opening are positioned outside of the main compartment.

In some embodiments, the wall is a side wall of the article.

In some embodiments, the holder is attached to the wall of the article by stitching along at least a portion of a side wall of the holder.

In some embodiments, the holder is attached to the side wall of the article by stitching along at least a portion of a side wall of the holder.

In some embodiments, the holder is stitched to an interior surface of the side wall of the article inside of the first opening of the article.

In some embodiments, the article further comprises a second opening in the wall, the second opening being aligned with the first opening to allow the holder to be moved to the first position.

In some embodiments, the article further comprises a second opening in the wall, the second opening being aligned with the first opening to allow the holder to be moved to the first position when the second opening is opened.

In some embodiments, the second opening is a closeable opening, and preferably a zippered opening.

In some embodiments, the first opening is closeable.

In some embodiments, the first opening is a zippered opening.

In some embodiments, the article further comprises an exterior retention means to releasably secure the holder against an outer surface of the article when the holder is in the second position.

In some embodiments, the exterior retention means comprises at least one of a strap, a press stud, and a magnet.

In some embodiments, the article further comprises an interior retention means that is configured to releasably secure the holder against an inner surface of the man compartment of the article when the holder is in the first position.

In some embodiments, the interior retention means comprises at least one of a strap, a press stud, and a magnet.

In some embodiments, the article further comprises a strap attached to an exterior of the article that is configured to wrap around and secure the holder.

In some embodiments, the article further comprises a first strap attached to an exterior of the article and a second strap attached to the exterior of the article, the first and second straps being configured to mate and wrap around and secure the holder.

In some embodiments, the article further comprises a strap attached to the article that is configured to wrap around and secure the holder.

In some embodiments, the article further comprises a first strap attached to of the article and a second strap attached to the article, the first and second straps being configured to mate and wrap around and secure the holder.

In some embodiments, the article further comprises a first mating portion of a clasp on the first strap and a second mating portion of the clasp on the second strap.

In some embodiments, at least one of the first and second straps has an adjustable length to secure contents of the holder against the article.

In some embodiments, the article further comprises an upper end of the holder that is configured to be tightened against a container.

In some embodiments, the article further comprises a pair of first eyelets at respective ends of a channel that is near an upper end of the holder; a cord extending through the channel and through the first pair of eyelets; and a cord clasp selectively movable along a length of the cord, wherein a user can cinch the cord clasp so as to tighten the cord clasp along the cord so that the upper end of the holder is tightened against a container within the holder.

In some embodiments, the holder is stitched to the wall.

In some embodiments, the first opening is positioned and arranged so the first opening can be in a closed position when the holder is in the first position, and wherein the second opening is positioned and arranged so the second opening can be in a closed position when the holder is in the second position.

In some embodiments, the holder further including at least one drain hole towards a lower end of the holder.

In some embodiments, the article comprises a first material, and the holder comprises the first material, and wherein the first material comprises one of nylon, canvas, and leather.

In some embodiments, the holder comprises a mesh fabric material.

In some embodiments, the article is a backpack and further comprises a shoulder strap.

In some embodiments, the first opening and the holder are configured and arranged so that with the holder in the first position, the upper end of the holder is facing an upper end of the article and a lower end of the holder is facing a lower end of the article.

In some embodiments, the holder is attached to the wall between the first zippered opening and the second zippered opening.

In some embodiments, the holder is attached to the wall of the article between the first opening and the second opening by stitching along a portion of a side wall of the holder.

In some embodiments, the container is a water bottle.

In some embodiments, the first opening is a zippered opening.

In some embodiments, the wall is a side wall of the article.

In some embodiments, the article has a main compartment opening to allow access to the main compartment and also to the holder when the holder is in first position within the main compartment.

According to another aspect of the present disclosure, a carrying article for supporting a container is provided, and the article comprises a main compartment including a side wall; a first zippered opening in the side wall; and a holder configured to hold a container, the holder being attached to the side wall, and the article, the first zippered opening and the holder being configured so that the holder is movable between a first position in which the holder is within the main compartment and can hold the container and a second position in which the holder extends through the first zippered opening and is accessible outside of the main compartment and can hold the container.

In some embodiments, the holder includes a holder side wall, a holder bottom wall and a holder opening, and in the second position at least a portion of the holder side wall, the holder bottom wall and the holder opening are positioned outside of the main compartment.

In some embodiments, the holder is attached to the side wall of the article by stitching along a portion of a side of the holder side wall.

In some embodiments, the holder is stitched to an interior surface of the side wall inside of the first zippered opening of the article.

In some embodiments, the article includes a second zippered opening in the side wall, the second zippered opening being aligned with the first zippered opening to allow the holder to be moved to the first position when the second zippered opening is opened.

In some embodiments, the article includes a first strap attached to the an outside surface of the article and including a first mating portion of a clasp and a second strap attached to an outside surface of the article and including a second mating portion of the clasp configured to mate with the first mating portion of the clasp, wherein, when the first and second mating portions of the clasp are mated together, the first and second straps wrap around the holder, and at least one of the first and second straps has an adjustable length to secure contents of the holder against the article.

In some embodiments, the article includes a pair of first eyelets at respective ends of a channel that is near an upper end of the holder; a cord extending through the channel and through the first pair of eyelets; and a cord clasp selectively movable along a length of the cord, wherein a user can cinch the cord clasp so as to tighten the cord clasp along the cord so that the upper end of the holder is tightened against a container within the holder.

In some embodiments, the holder is stitched to the side wall and first zippered opening is position and arranged so the first zippered opening can be in a closed position when the holder is in the first position, and wherein the second zippered opening is positioned and arranged so the second zippered opening can be in a closed position when the holder is in the second position.

In some embodiments, the holder includes at least one second eyelet near a lower end of the holder. In some embodiments, the second eyelet is configured to allow condensation from the container to exit the holder.

In some embodiments, the article comprises a first material, and wherein the holder comprises the first material, and wherein the first material comprises one of nylon, canvas, and leather.

In some embodiments, the article is a backpack and includes a shoulder strap.

In some embodiments, the article is a backpack and the first zippered opening and the holder are configured and arranged so that with the holder in the first position, the upper end of the holder is facing an upper end of the backpack and a lower end of the holder is facing a lower end of the backpack.

According to another aspect of the present disclosure, a carrying article for supporting a container is provided, and the article comprises a main compartment including a side wall; a first zippered opening in the side wall; a second zippered opening in the side wall, the second zippered opening being aligned with the first zippered opening; a holder configured to hold a container, the holder being attached to the side wall between the first zippered opening and the second zippered opening, the first zippered opening, the second zippered opening and the holder being configured so that the holder is movable between a first position in which the holder is within the main compartment and a second position in which the holder extends through the first zippered opening and is accessible outside of the main compartment.

In some embodiments, the holder includes a holder side wall, a holder bottom wall and a holder opening, and wherein in the second position at least a portion of the holder side wall, the holder bottom wall and the holder opening are positioned outside of the main compartment.

In some embodiments, the holder is attached to the side wall of the article between the first zippered opening and the second zippered opening by stitching along a portion of a side of the holder side wall.

In some embodiments, the second zippered opening is aligned with the first zippered opening, wherein the holder, first zippered opening and the second zippered opening are positioned and arranged so the first zippered opening can be in a closed position when the holder is in the first position and so that the second zippered opening can be in a closed position when the holder is in the second position.

In some embodiments, the article includes a first strap attached to the an outside surface of article and including a first mating portion of a clasp and a second strap attached to an outside surface of the article and including a second mating portion of the clasp configured to mate with the first mating portion of the clasp, wherein, when the first and second mating portions of the clasp are mated together, the first and second straps wrap around the holder, and at least one of the first and second straps has an adjustable length to secure contents of the holder against the article.

In some embodiments, the article includes a pair of first eyelets at respective ends of a channel that is near an upper end of the holder; a cord extending through the channel and through the first pair of eyelets; and a cord clasp selectively movable along a length of the cord, wherein a user can cinch the cord clasp so as to tighten the cord clasp along the cord so that the upper end of the holder is tightened against a container within the holder.

In some embodiments, the holder further includes at least one second eyelet near a lower end of the holder. In some embodiments, the second eyelet is configured to allow condensation from the container to exit the holder.

In some embodiments, the article comprises a first material, and wherein the holder comprises the first material, and wherein the first material comprises one of nylon, canvas, and leather.

In some embodiments, the article is a backpack and includes a shoulder strap.

In some embodiments, the article is a backpack, wherein the first zippered opening, the second zippered opening, and the holder are configured and arranged so that with the holder in the first position, the upper end of the holder is facing an upper end of the backpack and a lower end of the holder is facing a lower end of the backpack.

According to another aspect of the present disclosure, a backpack includes a main compartment including a side wall; a first zippered opening in the side wall; a holder configured to hold a container, the holder being attached to the side wall, and the holder being movable between: a first position in which the holder is within the main compartment, and a second position in which the holder extends through the first zippered opening and is accessible outside of the main compartment.

In some embodiments, the holder includes a holder opening and a holder side wall, wherein in the second position the holder opening and at least a portion of the holder side wall are outside of the main compartment.

In some embodiments, the holder further includes a bottom wall, wherein in the second position the bottom wall is outside of the main compartment.

In some embodiments, the holder is attached to the side wall by stitching along a portion of a side of the holder.

In some embodiments, the stitching is on an interior surface of the side wall of the backpack.

In some embodiments, the backpack includes a second zippered opening in the side wall, the second zippered opening being aligned with the first zippered opening to allow the holder to be moved to the first position when the second zippered opening is opened.

In some embodiments, the backpack includes a first strap attached to the backpack with a first mating portion of a clasp and a second strap attached to the backpack with a second mating portion of the clasp, wherein, when the first and second mating portions of the clasp are mated together, the first and second straps wrap around the holder, and at least one of the first and second straps has an adjustable length to secure contents of the holder against the backpack.

In some embodiments, the backpack includes a pair of first eyelets at respective ends of a channel near an upper end of the holder; a cord extending through the channel and through the first eyelets; and a cord clasp selectively movable along a length of the cord, wherein a user can synch the cord so the upper end of the holder is tightened against a bottle within the holder and a user can position the cord clasp along the cord to secure a bottle within the holder.

In some embodiments, the first zippered closure can be in a closed position when the holder is in the first position, and wherein the second zippered closure can be in a closed position when the holder is in the second position.

In some embodiments, the holder further includes at least one second eyelet near a lower end of the holder. In some embodiments, the second eyelet is configured to allow condensation from the water bottle to exit the holder.

In some embodiments, the backpack includes a zipper for a zippered opening of the main compartment.

In some embodiments, the backpack comprises a first material, and wherein the holder comprises the first material.

In some embodiments, the first material comprises one of nylon, canvas, and leather.

In some embodiments, the main compartment includes an internal pocket.

In some embodiments, the backpack includes a shoulder strap.

In some embodiments, the backpack includes at least one external pocket.

In some embodiments, the holder and the main compartment are dimensioned and configured to allow a user to position the holder in the first position such that an upper end of the holder is facing an upper end of the backpack and a lower end of the holder is facing a lower end of the backpack.

In some embodiments, a lower surface of the lower end of the holder is in direct facing relation with an upper surface of a bottom wall of the backpack at the lower end of the backpack.

According to another aspect of the present disclosure, a method of housing a container either within a main compartment of a carrying article or outside of the main compartment of the article is provided. In some embodiments, the method comprises providing the article having a main compartment, a side wall, a first zippered opening in the side wall, and a holder configured to hold a container, the holder being attached to the side wall, so that the holder is movable between a first position in which the holder is within the main compartment and can hold the container and a second position in which the holder extends through the first zippered opening and is accessible outside of the main compartment and can hold the container.

According to another aspect of the present disclosure, a method of housing a container either within a main compartment of a carrying article or outside of the main compartment of the article is provided, and the method comprises providing the article having a main compartment including a side wall, a first zippered opening in the side wall, a second zippered opening in the side wall, the second zippered opening being aligned with the first zippered opening, and a holder configured to hold a container, the holder being attached to the side wall between the first zippered opening and the second zippered opening, so that the holder is movable between a first position in which the holder is within the main compartment and a second position in which the holder extends through the first zippered opening and is accessible outside of the main compartment.

In some embodiments, the method includes providing the container with a second zippered opening in the side wall, the second zippered opening being aligned with the first zippered opening to allow the holder to be moved to the first position when the second zippered opening is opened.

In some embodiments, the method includes inserting a container in the holder and securing the container inside the main compartment of the article in the first position.

In some embodiments, the method includes inserting a container in the holder and securing the container to the side wall of the article in the second position.

In some embodiments, the method includes inserting a container in the holder and securing the container to the side wall of the article with a first strap attached to the an outside surface of article with a first mating portion of a clasp and a second strap attached to an outside surface of the article with a second mating portion of the clasp configured to mate with the first mating portion of the clasp, so that the first and second straps wrap around the holder and can be adjusted secure contents of the holder against the article in the second position.

In some embodiments, the method includes providing the holder with a pair of first eyelets at respective ends of a channel that is near an upper end of the holder, a cord extending through the channel and through the first pair of eyelets and a cord clasp selectively movable along a length of the cord, and synching the cord clasp so as to tighten the cord clasp along the cord so that the upper end of the holder is tightened against a container within the holder.

In some embodiments, the method includes opening the first zippered opening and second zippered opening and inserting the holder in the main compartment, then closing the first zippered enclosure.

In some embodiments, the method includes opening the first zippered opening and second zippered opening, removing the holder from the main compartment so that it is external to the article, then closing the second zippered opening.

It is appreciated that any of the features of any of the embodiments can be used with any of the aspects and embodiments and it is understood that they can so be combined in any manner.

BRIEF DESCRIPTION OF THE DRAWINGS

Various aspects of at least one embodiment are discussed below with reference to the accompanying figures. The figures are provided for the purposes of illustration and explanation and are not intended as a definition of the limits of the invention. In the figures.

LIST OF REFERENCE NUMERALS UTILIZED IN THE DRAWINGS

Figure 1:
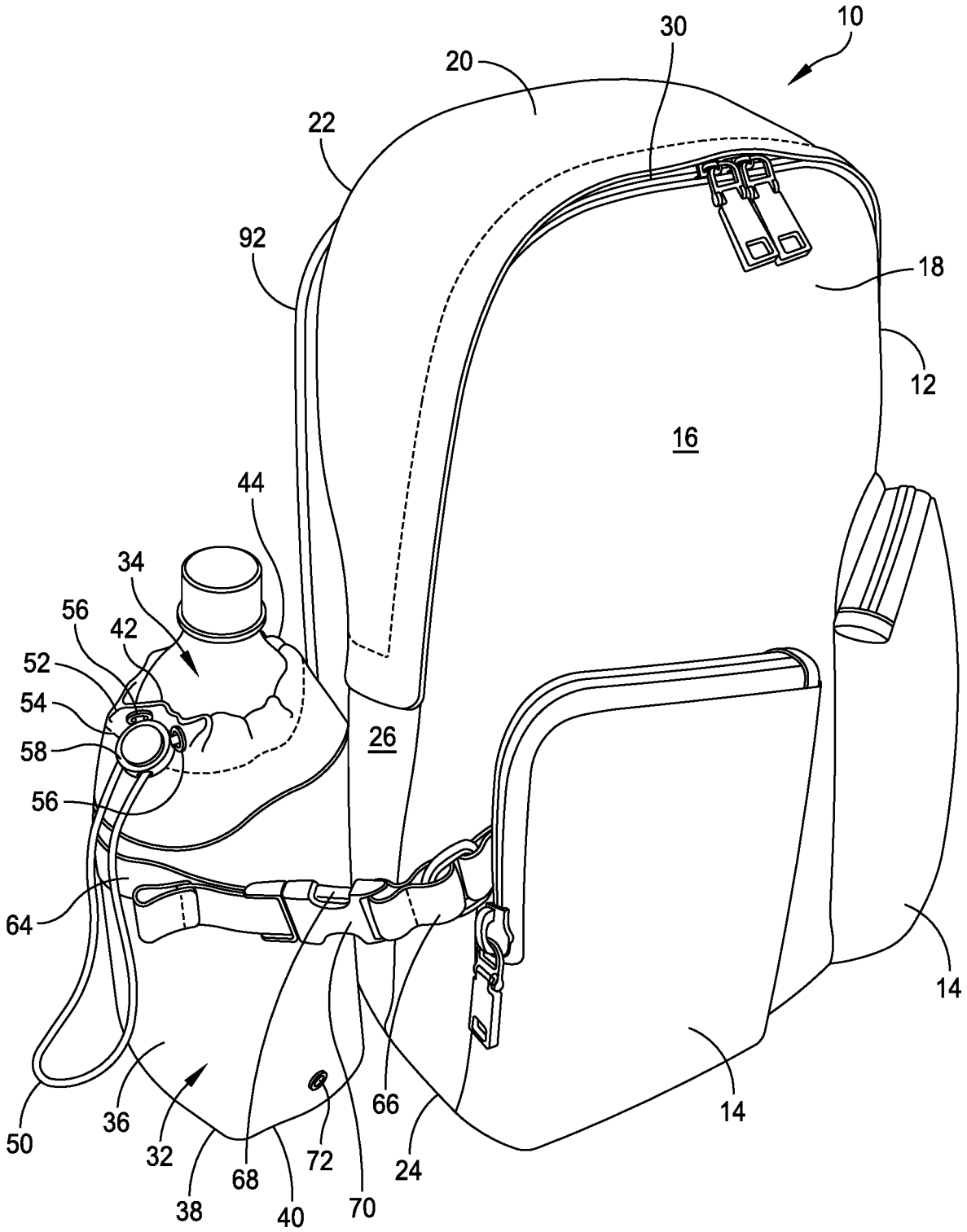
FIG. 1 is a perspective view of an exemplary embodiment of a backpack including a holder according to the present disclosure, with the holder in a first position.

With regard to reference numerals used, the following numbering is used throughout the description and drawings. Where technical features in the figures or detailed description are followed by these reference numerals, the reference numerals have been included for the sole purpose of increasing the intelligibility of the figures or detailed description. Accordingly, neither the reference numerals nor their absence is intended to have any limiting effect on the scope of any claim elements. In the figures, each identical or nearly identical component that is illustrated in various figures is represented by a like numeral. For purposes of clarity, not every component may be labeled in every figure.

Reference numeral 10 refers to backpack.

Reference numeral 12 refers to a main body of the backpack.

Reference numeral 14 refers to external pockets.

Reference numeral 16 refers to a front surface of a front wall 18 of the backpack.

Reference numeral 18 refers to a front wall of the backpack.

Reference numeral 20 refers to a top wall of the backpack.

Reference numeral 22 refers to a rear wall of the backpack.

Reference numeral 24 refers to a bottom wall of the backpack.

Reference numeral 26 refers to a side wall of the backpack.

Reference numeral 28 refers to a main compartment of the backpack.

Reference numeral 30 refers to a zipper track.

Reference numeral 32 refers to a holder for a container.

Reference numeral 34 refers to a container.

Reference numeral 36 refers to a side wall of the holder.

Reference numeral 38 refers to a lower wall of the holder.

Reference numeral 40 refers to a lower end of the holder.

Reference numeral 42 refers to a holder opening.

Reference numeral 44 refers to an upper end of the holder.

Reference numeral 50 refers to a cord.

Reference numeral 52 refers to a channel wall.

Reference numeral 54 refers to stitching.

Reference numeral 56 refers to eyelets.

Reference numeral 58 refers to a clasp.

Reference numeral 64 refers to a first strap.

Reference numeral 66 refers to a second strap.

Reference numeral 68 refers to a first mating portion of a clasp.

Reference numeral 70 refers to a second mating portion of a clasp.

Reference numeral 72 refers to an eyelet.

Reference numeral 74 refers to a port in the side wall 26.

Reference numeral 80 refers to an interior surface of the side wall 26.

Reference numeral 82 refers to stitching

Reference numeral 84 refers to a first zippered opening.

Reference numeral 86 refers to a second zippered opening.

Reference numeral 88 refers to an upper end of the backpack.

Reference numeral 90 refers to internal pockets.

Reference numeral 92 refers to a shoulder strap.

DETAILED DESCRIPTION

Reference will now be made in detail to representative embodiments illustrated in the accompanying drawings. It should be understood that the following descriptions are not intended to limit the embodiments to one preferred embodiment. To the contrary, they are intended to cover alternatives, modifications, and equivalents as may be included within the spirit and scope of the described embodiments as disclosed. It is appreciated that any of the features of any of the embodiments can be used with any of the aspects and embodiments and it is understood that they can so be combined in any manner.

According to the present disclosure, a carrying article includes a holder that is configured to hold a container either within a main compartment of the carrying article or to hold the container outside of the carrying article. The carrying article can be a variety of articles including for example, backpacks, briefcases, tote bags, pocketbooks, purses, messenger bags, duffel bags, sports equipment bags, suitcases including soft-shell luggage and hard-shell luggage, and other bags. In some embodiments, the carrying article is an article of luggage. A user can selectively position and use the holder within the main compartment or outside of the main compartment as desired. When the user wants to carry a container, such as a water bottle, within the article, the user can position the holder within the main compartment of the article in a first position. The holder is configured to support the water bottle in an upright orientation when the bottle is received in the holder in the main compartment of the luggage. When the user wants to reserve more of the main compartment for other objects, or when the user wants to more easily access the bottle, the user can position the holder outside of the main compartment of the article in a second position. The holder is configured to support the water bottle in an upright orientation when the bottle is received in the holder outside of the main compartment.

In some embodiments, the holder is adjacent a panel of the carrying article when the holder is positioned outside of the article in the second position.

In some embodiments, the carrying article is a backpack, or another over-the-shoulder bag. While the figures of the present disclosure show a backpack, the holder of the present disclosure may be included in other bags or luggage. For example, the article can include for example, backpacks, briefcases, tote bags, pocketbooks, purses, messenger bags, duffel bags, sports equipment bags, suitcases including soft shell luggage, hard shell luggage, and other bags.

In some aspects and embodiments, the article is a backpack that includes a main compartment that has a wall. A first opening and a second opening define a port in the wall. A holder is configured to hold a container, and the holder is attached to the wall of the backpack. The holder is movable through the port, so that the holder can be selectively positioned in a first position in which the holder is in the main compartment or a second position in which the holder extends through the first opening and is accessible outside of the main compartment. In some embodiments, the wall that the port is defined in is a side wall of the main compartment. However, the wall can also be a front wall of the main compartment, or another wall of the article. In some embodiments, the first opening is a closeable opening, such as a zippered opening. In some embodiments, the second opening is a closeable opening, such as a zippered opening.

FIG. 1 shows an exemplary embodiment of a backpack 10 having a main body 12. Two optional external pockets 14 are located on a front surface 16 of a front wall 18 of the main body 12. A user can store a variety of items in the external pockets 14. The backpack 10 also includes a top wall 20, a rear wall 22, a bottom wall 24, and a side wall 26 that together with the front wall 14 enclose a main compartment 28 for storing other items. The side wall 26 of the backpack 10 is also a side wall of the main compartment 28. To allow a user to access the main compartment 28, a main compartment zipper track 30 extends along an edge of the front face 16 of the front wall 18 of the main body 12.

The backpack 10 also includes a holder 32 that is configured to hold a container 34. The holder 32 includes a holder side wall 36 that extends from a lower wall 38 of the holder 32 at a lower end 40 of the holder 32 to a holder opening 42 defined at an upper end 44 of the holder 32.

In FIG. 1, the holder 32 is illustrated as being positioned substantially entirely outside of the main compartment 28 of the backpack 10, so that a container 34 held in the holder 32 is located outside of the main compartment and is accessible to a user without requiring the user to open the main compartment zipper 30. The holder 32 is attached to the side wall 26 of the backpack 10, as will be discussed further herein. The holder 32 is also selectively movable between the second position shown in FIG. 1 and a first position in which the holder 32 is located within the main compartment 28 and allows a user to store a container 34 within the holder 32 in the main compartment 28, as is discussed further herein.

In either of the first position and the second position, the holder 32 supports the container 34 in an upright position. The opening 42 at the upper end 44 of the holder 32 is substantially vertically above the lower end 40 of the holder 32 when the backpack 10 is in an upright position with a container 34 in the holder 32, as shown in FIG. 1.

The container 34 is just one example of a container that could be received in the holder 32. The holder 32 is configured to receive and support a variety of containers. For example, in some embodiments, the holder is configured to support a beverage container. In some embodiments, the holder is configured to support a bottle having an internal volume of between 4 fluid ounces and 40 fluid ounces. In some embodiments, the beverage container is a conventional sports water bottle.

The holder 32 is configured to secure the container 34 when the container 34 is supported in the holder 32. A user may tighten a cord 50 at the upper end 44 of the holder 32 to secure the container 34 in the holder 32. The cord 50 extends through a channel wall 52 around a periphery of the opening 42. The channel wall 52 has stitching 54 so that the channel wall 52 retains the cord 50 towards the upper end 44 of the holder 32. The cord 50 extends through a pair of first eyelets 56 at respective ends of the channel 52 near the upper end 44 of the holder 32. A cord clasp 58 is selectively movable along a length of the cord 50. To secure the container 34 in the holder 32, a user can cinch the cord 50 so the opening 42 at the upper end 44 of the holder 32 is tightened against the container 34. The user can then position the clasp 58 along the cord 50 so the clasp 58 is adjacent the first eyelets 56.

Although the holder 32 is secured to the backpack 10 as further discussed below, it is desirable to further stabilize the holder 32 and container 34 against the backpack 10. To further stabilize the holder 32 and container 34 against the side wall 26 of the backpack 10, the backpack 10 includes an exterior retention means to releasably secure the holder against an outer surface of the article when the holder is in the second position. In various embodiments, the exterior retention means includes any of a strap, a press stud, a magnet and/or another retention means. In FIG. 1, the retention means is shown as a first strap 64 that is attached to an exterior of the backpack 10 and a second strap 66 that is attached to the exterior of the backpack 10. A first mating portion 68 of a clasp is secured to the first strap 64, and a second mating portion 70 of the clasp is secured to the second strap 66. When the first mating portion 68 and the second mating portion 70 of the clasp are mated together, the first and second straps 64, 66 together wrap around the holder 32 to limit movement of the holder 32 and container 34 relative to the side wall 26 of the backpack 10. As illustrated in FIG. 1, the first strap 64 is configured to have an adjustable length so the straps 64, 66, are useful for securing a variety of containers having different diameters against the side wall 26 of the backpack 10. In some embodiments, both the first strap 64 and the second strap 66 are adjustable.

In some embodiments, a single strap is used. The single strap may be secured at its two ends to an exterior of a carrying article, and is configured to wrap around and secure the holder. The single strap may be elasticized.

In some embodiments, the exterior retention means include a magnet positioned in the side wall 36 of the holder 32. For example, in some embodiments, a magnet in the side wall of the holder may be used in conjunction with a strap having a metal clasp. The magnet may be configured to magnetically secure the metal clasp against the side wall 36 of the holder 32. In some embodiments, a portion of the holder is stitched to a carrying article (such as a backpack), and a magnet in the side wall of the holder and a magnet in a surface of the carrying article may be used to further secure another portion of the side wall of the holder to the side wall of the article.

Some embodiments of the holder 32 include at least one second eyelet (or drain hole) 72 near the lower end 40 of the holder 32. It is appreciated that one of the functions and advantages of the eyelet 72 is to allow condensation or other fluids to exit from the holder.

Figure 2:
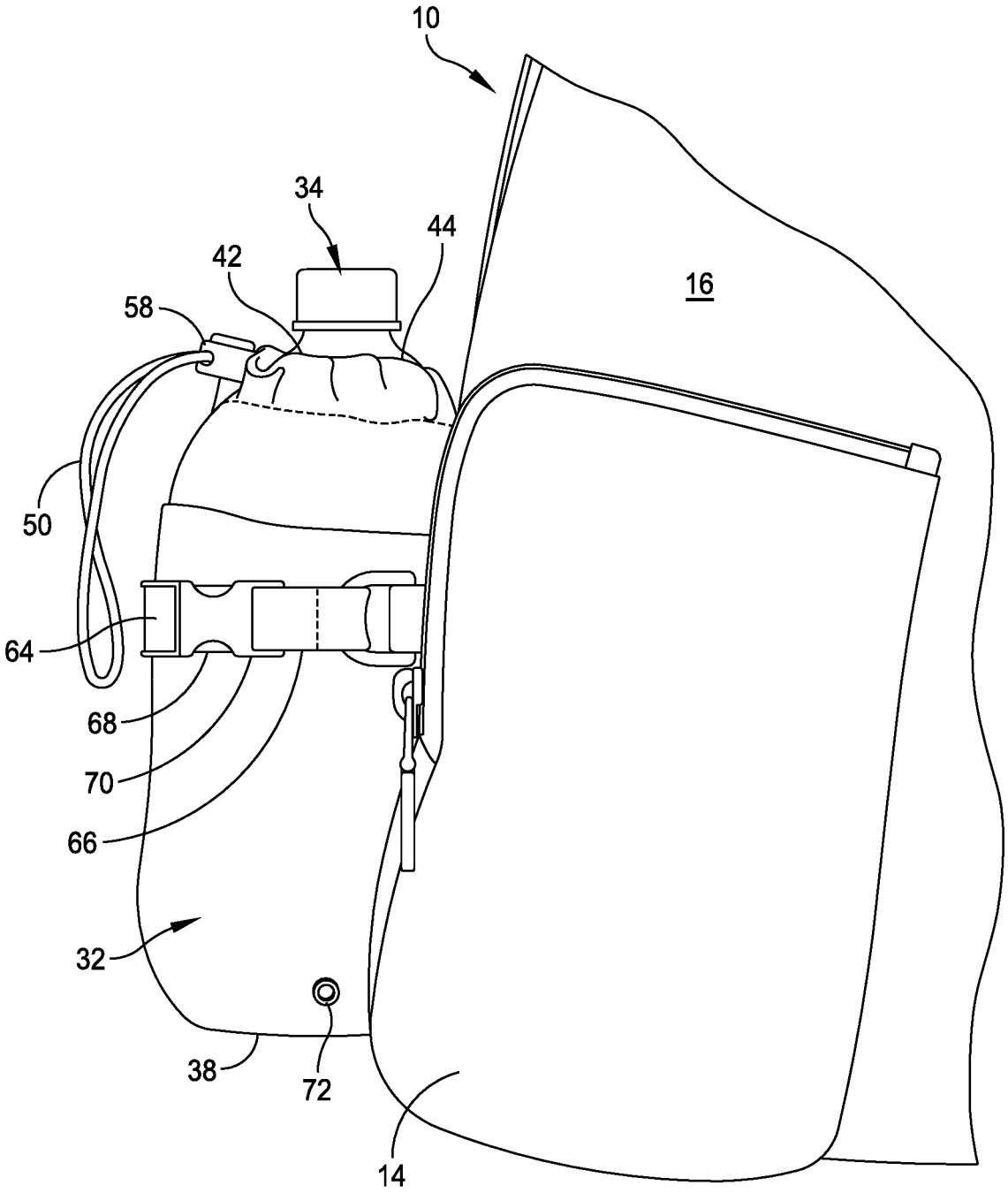
FIG. 2 is a partial front view of the backpack and holder of FIG. 1.

FIG. 2 is a partial front view of the backpack and holder of FIG. 1. FIG. 2 illustrates a front view of the holder 32 supporting a bottle/container 34 in a position in which the holder 32 is accessible outside of the main compartment 28 of the backpack 10. As illustrated in FIG. 2, the container 34 when held in the holder 32 is accessible to a user even when the main compartment 28 is closed. A user can place the container 34 in the holder 32 by inserting the container 34 into the opening 42 and can remove the container 34 from the holder 32 by removing the container 34 from the opening 42. The lower wall of the holder 38 supports a lower end of the container 34 so that an appropriately sized container 34 extends out of the holder 32 at the opening 42 located at the upper end 44 of the holder. It can be seen from FIG. 2 that the holder is accessible in the second position, even when the main compartment 28 of the backpack 10 is closed.

Figure 3:
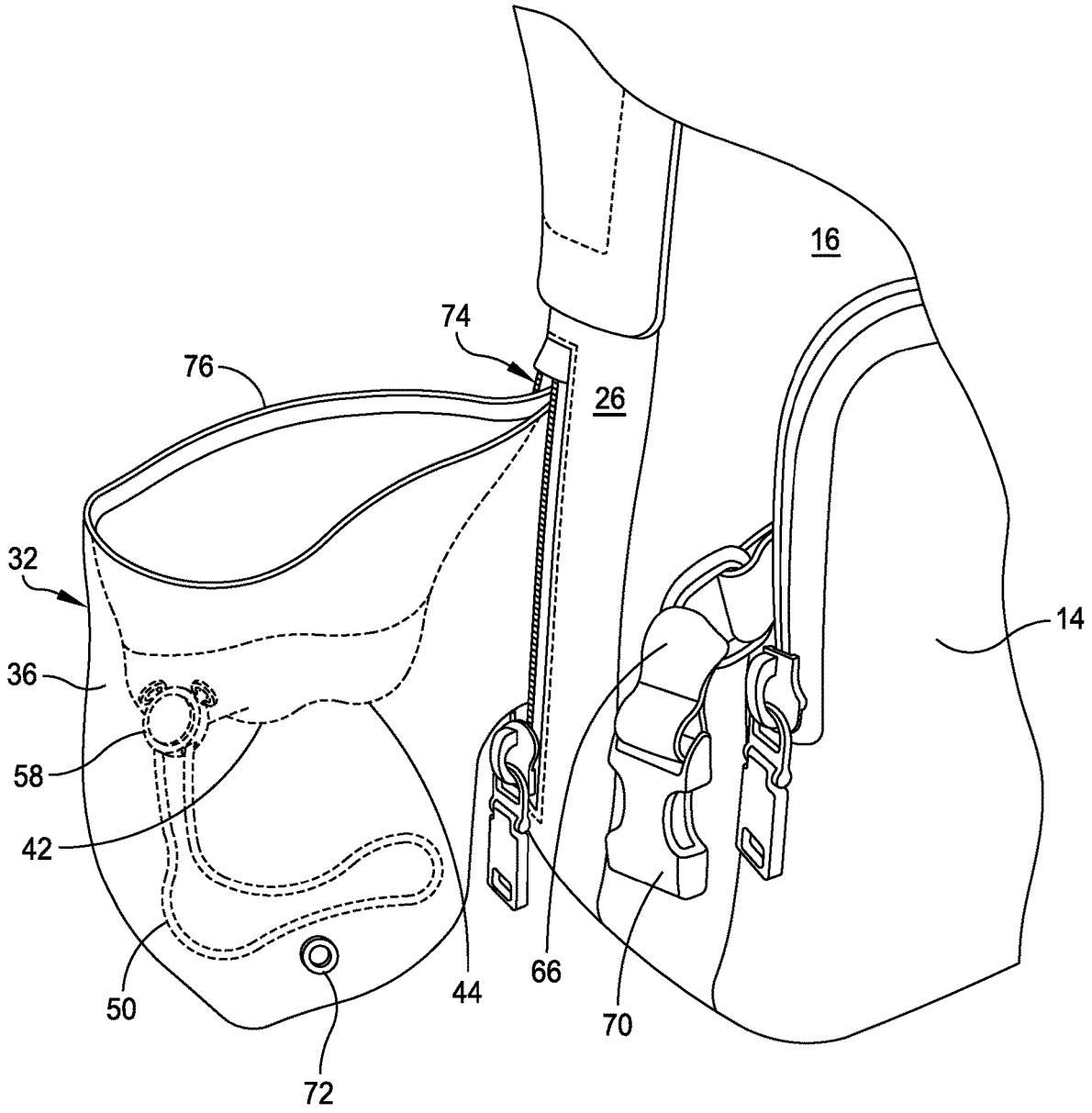
FIG. 3 is a partial perspective view of the backpack and holder of FIG. 1.

FIG. 3 is a partial perspective view of the backpack and holder of FIG. 1. As illustrated in FIG. 3, the side wall 26 of the main compartment 28 includes a port 74 that allows a user to move the holder 32 in and out of the main compartment 28 between respective first and second positions. Because the port 74 is formed in the side wall 26, and because the holder 32 is attached to an internal structure of the port 74 as discussed below in relation to FIG. 4, substantially all of the holder 32 is outside of the main compartment 28 of the backpack 10 when the holder 32 is in the second position illustrated in FIGS. 1-2.

Referring to FIGS. 3-7, FIGS. 3-7 in combination illustrate the holder 32 in the second position substantially outside of the main compartment of the backpack, and illustrate various steps of moving the holder 32 through the port 74 from the second position in which the holder 32 is outside of the main compartment 28 to the first position in which the holder 32 is in the main compartment 28.

In FIG. 3, the user has removed a container 34 from the holder 32 and inverted the upper end 44 of the holder 32 to be positioned inward of the side wall 36 of the holder 32. To illustrate this, the opening 42 of the holder, the cord 50, and the cord clasp 58 are shown in broken lines in FIG. 3. With the upper end 44 of the holder 32 inverted, the holder 32 has a smaller profile as illustrated in FIG. 3. A trim portion 76 forms a compact upper edge of the holder 32. The compact configuration of the holder 32 as illustrated in FIG. 3 allows a user to more easily move the holder into the main compartment 28 to the first position. It is appreciated that the compact configuration of the holder also provides an improved aesthetic appearance of the holder 32 if the user does not move the holder 32 into the main compartment 28. It is appreciated that in some instances, when a user does not need to carry the container 34 and does not wish to move the holder 32 into the main compartment, a user may invert the holder 32 as shown in FIG. 3 without proceeding to the subsequent steps of moving the holder 32 into the main compartment 28.

Figure 4:
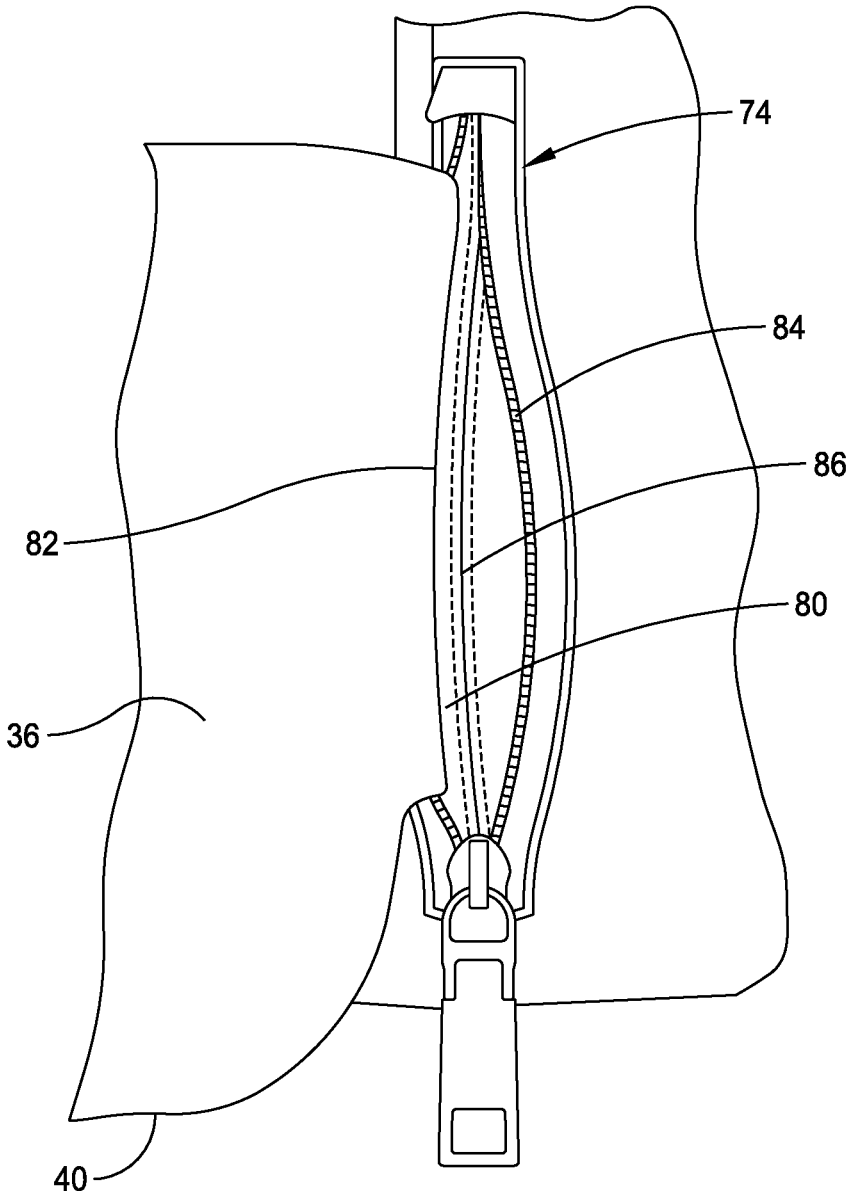
FIG. 4 is a partial side view of the backpack and holder of FIG. 1.

Referring now to FIG. 4, FIG. 4 is a partial side view of the backpack and the holder of FIG. 1. The holder 32 is attached to the side wall 26 by a fastener. For example, the holder 32 is attached to the side wall 26 by a fastener along at least a portion of the side wall 36 of the holder 32. In FIG. 4, the holder 32 is attached to an interior surface 80 of the side wall 26 of the backpack by stitching 82. In other embodiments, the holder 32 may be attached by another attachment means, such as rivets, adhesives, staples, a melted joint, or any other fastener that is known to those of skill in the art.

FIG. 4 shows the holder 32 secured to an interior surface 80 of the side wall 26 of the backpack by stitching 82. In some embodiments, the holder may be instead secured to another surface of the backpack, or other carrying article. For example, in some embodiments, the holder may be secured to an outer surface of a carrying article. In embodiments in which the holder is secured to an outer surface of a carrying article, it may still be moved between a first position in which the holder extends into and the main compartment of the carrying article to hold a container within the main compartment and a second position in which the holder is outside of the main compartment.

FIG. 4 illustrates that the holder 32 extends through a first zippered opening 84 in the side wall 26 of the backpack 10. When the holder 32 is positioned outside of the main compartment 28 of the backpack 10 in the second position, the first zippered opening 84 is in an open position. FIG. 4 also illustrates a second zippered opening 86 is formed in the side wall 26 of the backpack 10 and internal to the first zippered opening 84. The second zippered opening 86 is aligned with the first zippered opening 84 and is in adjacent facing relation with the first zippered opening 84. Because the second zippered opening 86 is aligned with the first zippered opening 84, the second zippered opening 86 allows the holder 32 to be moved to the first position inside the main compartment of the back pack when the first zippered opening 84 and the second zippered opening 86 are opened. After the holder 32 is moved to the first position in the main compartment, the first zippered opening 84 can be zippered closed.

Figure 5:
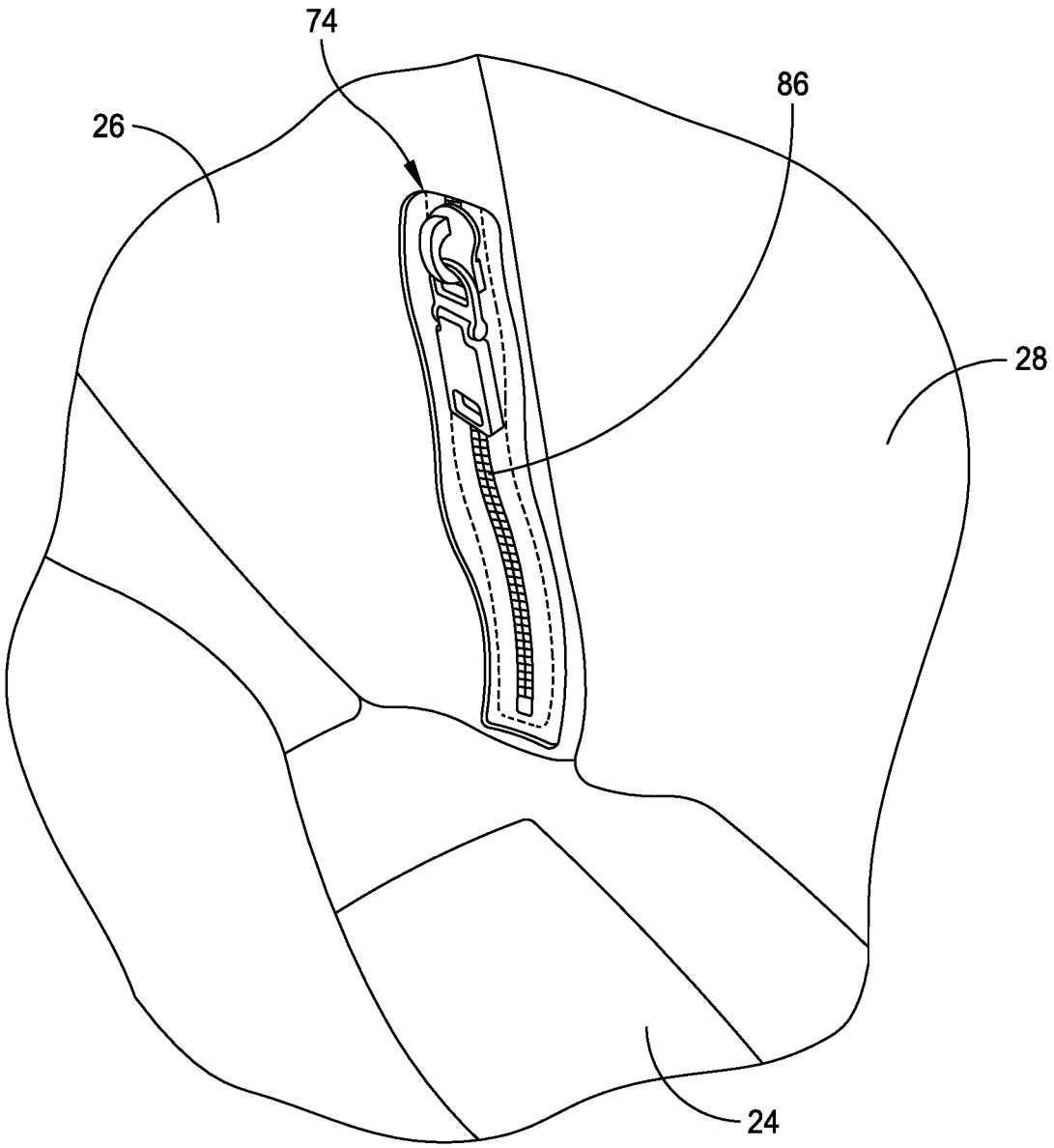
FIG. 5 is a partial perspective view of a main compartment of the backpack of FIG. 1.

FIG. 5 shows an internal view of the main compartment of the backpack with the holder 32 in the configuration of FIG. 4 (the second position). In the second position, the second zippered opening 86 can be a closed position when the holder 32 is located outside of the main compartment 28 of the backpack 10. With the second zippered opening 86 is in the closed position, the second zippered opening 86 prevents access to the main compartment 28 through the first zippered opening 84. In this way, a user can use the holder 32 outside of the main compartment 28 without hindering the ability of the main compartment 28 to retain objects in the main compartment 28 of the backpack 10.

Figure 6:
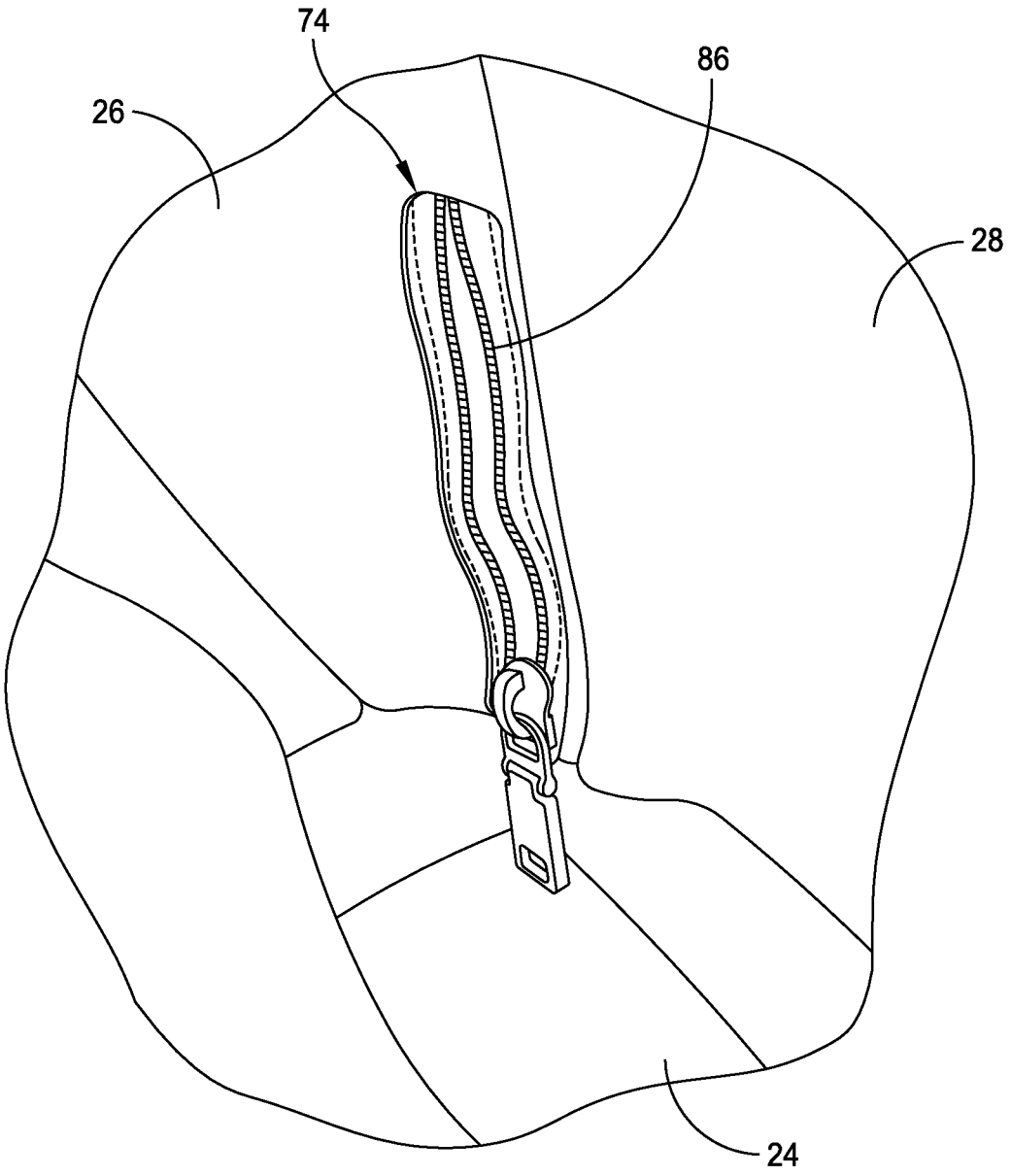
FIG. 6 is another partial perspective view of a main compartment of the backpack of FIG. 1.
Figure 7:
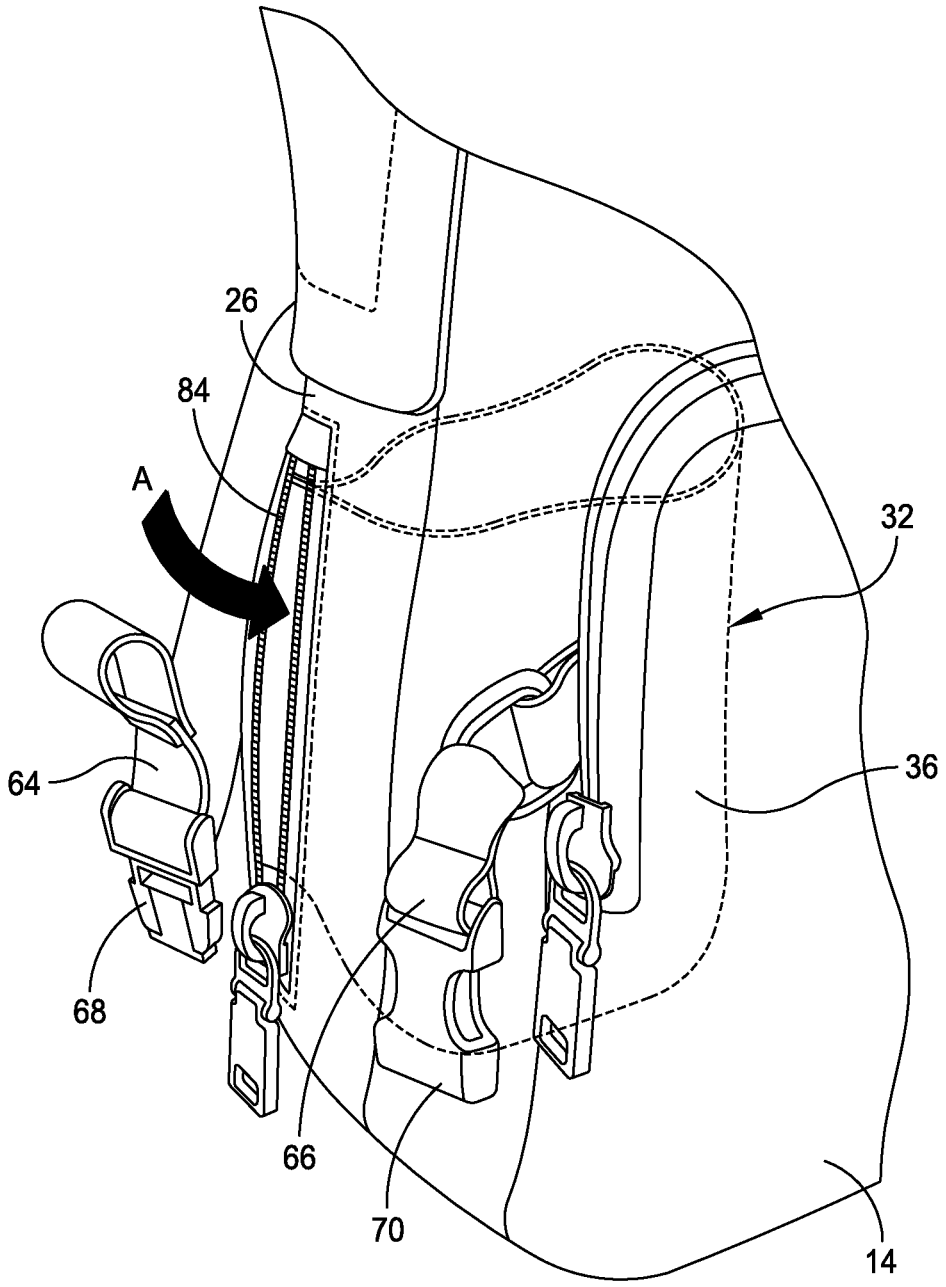
FIG. 7 is a partial perspective view of the backpack and holder of FIG. 1 with the holder in a second position.
Figure 8:
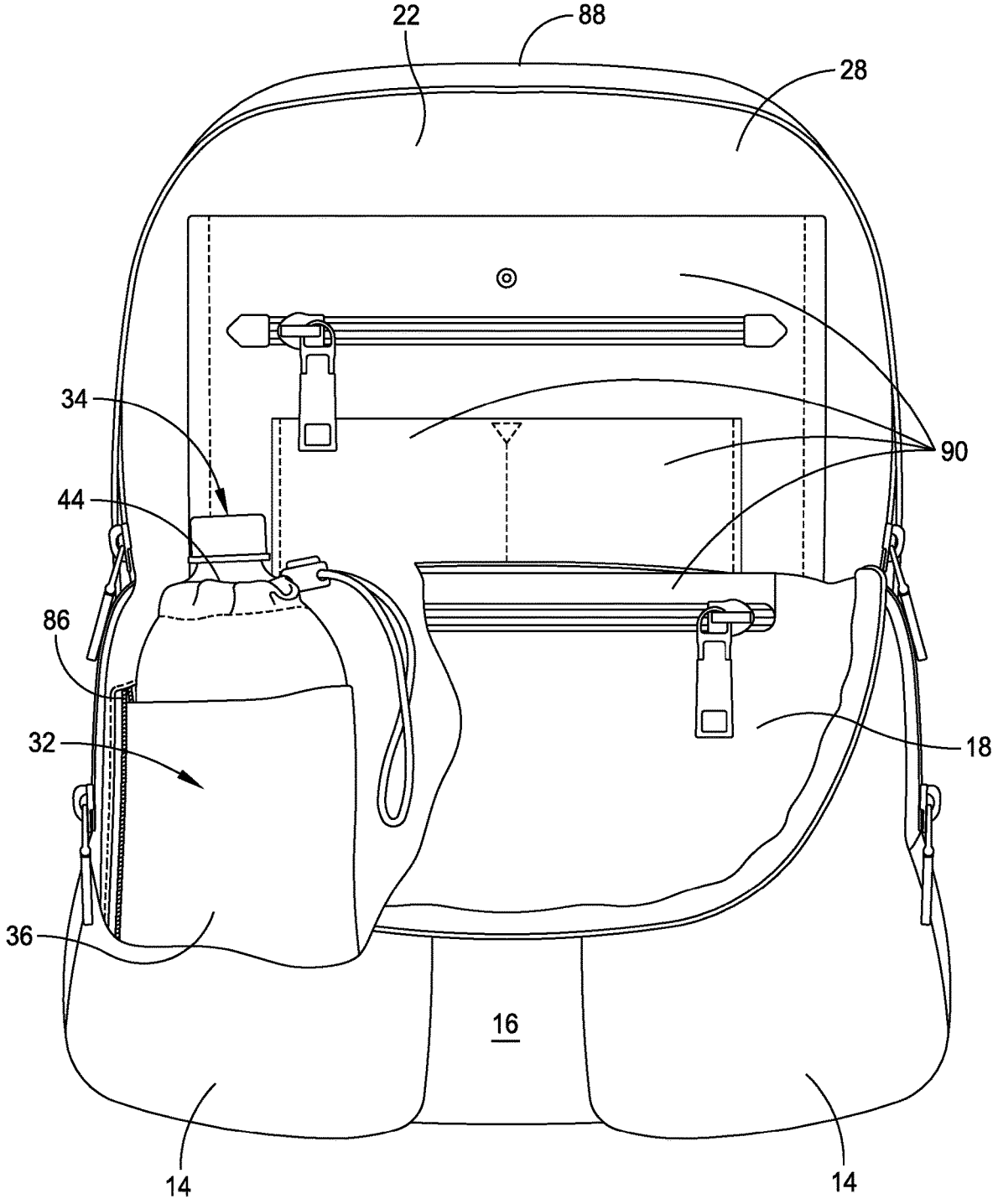
FIG. 8 is a front cutaway view of the backpack and holder of FIG. 1, with the holder in the second position.

Referring to FIGS. 6-8, there are illustrated some of the steps of moving the holder 32 through the port 74 from the second position in which the holder 32 is outside of the main compartment 28 to the first position in which the holder 32 is in the main compartment 28. To move the holder 32 from the second position in which the holder 32 is outside of the main compartment 28 to the first position in which the holder 32 is inside the main compartment 28, the user opens the second zippered opening 86, as shown in FIG. 6. Then the user moves the holder 32 along the arrow A shown in FIG. 7, through the first zippered opening 84, through the second zippered opening 86, and into the main compartment 28 of the backpack 10.

FIG. 8 is a front cutaway view of the backpack and holder of FIG. 1, with the holder in the first position. In particular, FIG. 8 shows the holder 32 positioned in the main compartment 28 of the backpack 10. The holder 32 and the main compartment 28 are dimensioned and configured to allow a user to position the holder 32 in the first position such that the upper end 44 of the holder 32 is facing an upper end 88 of the backpack 10 and the lower end 40 of the holder 32 is facing the bottom wall 24 of the backpack 10. In both the first and second position, the holder 32 supports the container 34 in an upright position. The opening 42 at the upper end 44 of the holder 32 is substantially vertically above the lower end 40 of the holder 32 when the backpack 10 is in an upright position with the container 34 in the holder 32 as shown in FIG. 8. With the holder 32 in the first position and retaining a container, the lower surface of the lower end of the holder is in direct facing relation with an upper surface of a bottom wall 24 of the backpack 10 at the lower end of the backpack 10.

In some embodiments, the backpack includes an interior retention means that is configured to releasably secure the holder against an inner surface of the man compartment of the article when the holder is in the first position. In various embodiments, the interior retention means may include any of a strap, a press stud, and a magnet. In some embodiments, the interior retention means includes a magnet positioned in the side wall 36 of the holder 32. For example, in some embodiments, a magnet in the side wall of the holder may be used in conjunction with a magnet in an interior surface of a carrying article. The magnet in the side wall of the holder and the magnet in the interior surface of the carrying article are configured to magnetically secure the side wall of the holder against the interior surface of the carrying article.

In the first position of the holder 32, the holder 32 and the container 34 supported in the holder 32 take up some of the volume of the main compartment 28. However, it is appreciated that when the holder 32 is in the first position and the container is supported in the holder 32, a user can still use the remainder of the main compartment 28 to transport other objects. With the holder 32 in the first position of the holder, the first zippered opening 84 can be closed to prevent objects from passing through the first zippered opening 84.

Figure 9:
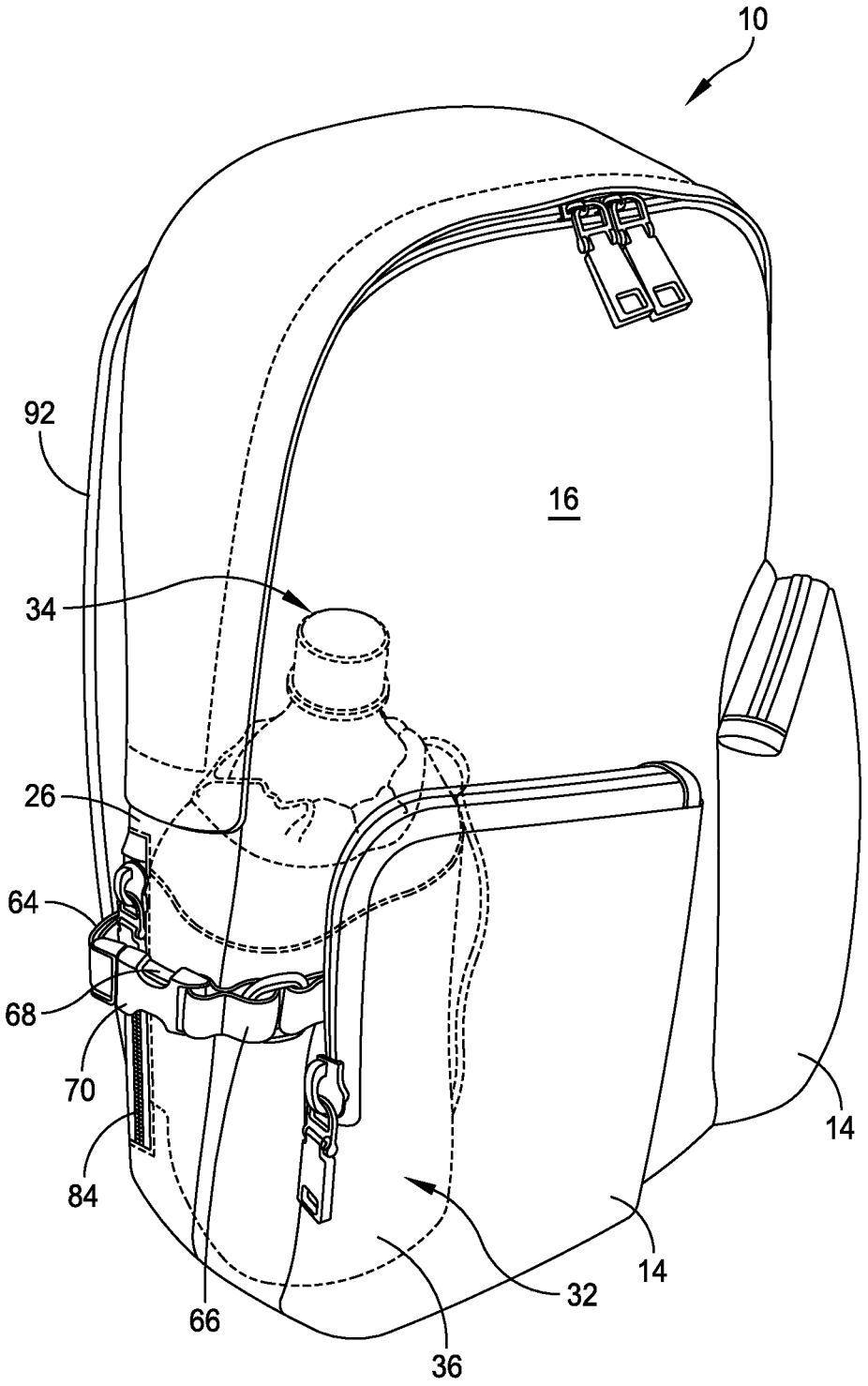
FIG. 9 is a perspective view of the backpack showing the holder in broken lines in the second position.

Referring to FIG. 9, FIG. 9 is a perspective view of the backpack showing the holder in broken lines in the first position. FIG. 9 shows that the first zippered opening 84 can be in a closed position when the holder 32 is positioned within the main compartment 28 of the backpack 10. When the first zippered opening 84 is in the closed position, the first zippered opening 84 prevents access to the main compartment 28 through the first zippered opening 84. In this way, a user can use the holder 32 inside the main compartment 28 without hindering the ability of the main compartment 28 to retain objects in the main compartment 28. When the holder 32 is positioned within the main compartment 28, the first strap 64 and the second strap 66 can be held flush against the side wall 26 of the backpack 10, as illustrated in FIG. 9.

The backpack optionally includes other features commonly found on backpacks known in the art. In FIG. 8, the front wall 18 of the backpack 10 is folded down to reveal internal pockets 90 that are located in the main compartment 28. Additionally, the backpack 10 includes a shoulder strap 92, a handle, or another means for picking up the backpack 10. The backpack 10 is formed from one or more of a variety of materials 10. For example, the backpack 10 can be formed from nylon, canvas, leather, and/or another material. The backpack can include any material known to those of skill in the art.

The holder 32 is formed from one or more of a variety of materials. The holder 32 is made of material(s) with sufficient flexibility to allow the holder to be moved through the first zippered opening 84 and the second zippered opening 86 of the port 74, and with sufficient strength to allow the holder 32 to support a container, such as a bottle, within the holder. For example, the holder can be formed from a material such as nylon, canvas, leather, and/or another material. In some embodiments, the holder is formed from a mesh fabric material. In some embodiments, the holder and the backpack are formed from the same material or formed from the same materials.

As can be seen from the above description, the present disclosure provides a holder that allows a user to selectively support a container in an upright position either inside a main compartment of a carrying article or outside the main compartment of a carrying article.

This allows a user to allocate the volume of the main compartment as desired. When the user has sufficient volume available in the main compartment to position a container, such as a bottle, in the main compartment, the user can move the holder into the main compartment to the first position as described herein so that the bottle does not obscure any portion of the outside of the backpack. Some of the advantages of housing the container in the first described position are that it improves the aesthetic appearance of the backpack and the container is potentially held in a more secure position than in the second position. When the user cannot fit the container in the main compartment of the backpack along with other objects the user would like to carry in the main compartment of backpack, or when the user would like to position the container outside of the main compartment for any other reason such as ease of accessibility to the container, the user can move the holder to a position located outside of the main compartment to the second position as described herein. Some of the advantages of housing the container in the second described position are the ease of accessibility to the container and that the container is securely held against the side wall of the container.

While the disclosed subject matter is described herein in terms of certain exemplary embodiments, those skilled in the art will recognize that various modifications and improvements can be made to the disclosed subject matter without departing from the scope thereof. As such, the particular features claimed below and disclosed above can be combined with each other in other manners within the scope of the disclosed subject matter such that the disclosed subject matter should be recognized as also specifically directed to other embodiments having any other possible permutations and combinations. It will be apparent to those skilled in the art that various modifications and variations can be made in the systems and methods of the disclosed subject matter without departing from the spirit or scope of the disclosed subject matter. Thus, it is intended that the disclosed subject matter include modifications and variations that are within the scope of the appended claims and their equivalents.

What is claimed:

1. A backpack carrying article comprising:

a main compartment including a wall;

a first opening in the wall of the backpack carrying article; and an open top holder sized and arranged to hold a water bottle or flask container, the open top holder being attached to an inner wall of the first opening in the wall of the backpack carrying article, the open top holder being configured so that the holder is movable between a first position in which the open top holder is within the first opening in the main compartment of the backpack and can hold the container in a vertical orientation within the backpack and a second position in which the open top holder extends through the first opening and is accessible outside of the main compartment of the backpack and can hold the container in the vertical orientation outside of the main compartment.

2. The article of claim 1, wherein the holder includes a holder side wall, a holder bottom wall and a holder top opening, and wherein in the second position at least a portion of the holder side wall, the holder bottom wall and the holder opening are positioned outside of the main compartment.

3. The article of claim 1, wherein the wall is a side wall of the article.

4. The article of claim 1, wherein the holder is attached to the wall of the article by stitching along at least a portion of a side wall of the holder.

5. The article of claim 3, wherein the holder is stitched to an interior surface of the side wall of the article inside of the first opening of the article.

6. The article of claim 1, further comprising a second opening in the wall, the second opening being aligned with the first opening to allow the holder to be moved to the first position.

7. The article of claim 6, wherein the first opening is positioned and arranged so the first opening can be in a closed position when the holder is in the first position, and wherein the second opening is positioned and arranged so the second opening can be in a closed position when the holder is in the second position.

8. The article of claim 6, wherein the holder is attached to the wall between the first opening and the second opening.

9. The article of claim 6, wherein the second opening is a closeable opening, and preferably a zippered opening.

10. The article of claim 1, wherein the first opening is closeable.

11. The article of claim 10, wherein the first opening is a zippered opening.

12. The article of claim 1, further comprising an exterior retention means to releasably secure the holder against an outer surface of the article in the vertical orientation when the holder is in the second position.

13. The article of claim 12, wherein the exterior retention means comprises at least one of a press stud and a magnet.

14. The article of claim 1, further comprising an interior retention means that is configured to releasably secure the holder against an inner surface of the main compartment of the article when the holder is in the first position.

15. The article of claim 14, wherein the interior retention means comprises at least one of a press stud and a magnet.

16. The article of claim 1, further comprising at least one strap attached to the article that is configured to wrap around and secure the holder against an outer surface of the article in the vertical orientation.

17. A carrying article comprising:

a main compartment including a wall;

a first opening in the wall; and a holder configured to hold a container, the holder being attached to the wall of the carrying article, the first opening and the holder being configured so that the holder is movable between a first position in which the holder is within the main compartment and can hold the container and a second position in which the holder extends through the first opening and is accessible outside of the main compartment and can hold the container outside of the main compartment;

further comprising a first strap attached to the article and a second strap attached to the article, the first and second straps being configured to mate and wrap around and secure the holder.

18. The article of claim 17, further comprising a first mating portion of a clasp on the first strap and a second mating portion of the clasp on the second strap.

19. The article of claim 17, wherein at least one of the first and second straps has an adjustable length to secure contents of the holder against the article.

20. The article of claim 1, wherein the open top holder is configured to be tightened against the container.

21. The article of claim 1, further comprising a pair of first eyelets at respective ends of a channel that is near open top of the holder;

a cord extending through the channel and through the first pair of eyelets; and a cord clasp selectively movable along a length of the cord, wherein a user can cinch the cord clasp so as to tighten the cord clasp along the cord so that the upper end of the holder is tightened against a container within the holder.

22. The article of claim 1, the holder further including at least one drain hole towards a lower end of the holder.

23. The article of claim 1, wherein the article comprises a first material, and wherein the holder comprises the first material, and wherein the first material comprises one of nylon, canvas, and leather.

24. The article of claim 1, wherein the holder comprises a mesh fabric material.

25. The article of claim 1, wherein the backpack carrying article is a further comprises a pair of shoulder straps.

26. The article of claim 1, wherein the first opening and the holder are configured and arranged so that with the holder in the first position, the upper end of the holder is facing an upper end of the article and a lower end of the holder is facing a lower end of the article.

27. The article of claim 1, wherein the a main compartment includes a main opening to allow access to the main compartment and also to the open top holder when the holder is in first position within the main compartment.

* * * * *